US007920100B2

(12) United States Patent
Brown et al.

(10) Patent No.: US 7,920,100 B2
(45) Date of Patent: Apr. 5, 2011

(54) FOLDABLE REFLECT ARRAY

(75) Inventors: Kenneth W. Brown, Yucaipa, CA (US); William E. Dolash, Montclair, CA (US); Travis B. Feenstra, Redlands, CA (US); Michael J. Sotelo, Chino, CA (US)

(73) Assignee: Raytheon Company, Waltham, MA (US)

( * ) Notice: Subject to any disclaimer, the term of this patent is extended or adjusted under 35 U.S.C. 154(b) by 330 days.

(21) Appl. No.: 12/169,580

(22) Filed: Jul. 8, 2008

(65) Prior Publication Data

US 2009/0073073 A1 Mar. 19, 2009

Related U.S. Application Data

(63) Continuation-in-part of application No. 11/207,049, filed on Aug. 18, 2005, now Pat. No. 7,490,538.

(51) Int. Cl.
*H01Q 1/08* (2006.01)
*H01Q 19/10* (2006.01)

(52) U.S. Cl. ..... 343/818; 343/881; 342/10

(58) Field of Classification Search ..... 342/5–10; 343/818, 881

See application file for complete search history.

(56) References Cited

U.S. PATENT DOCUMENTS

| | | | | |
|---|---|---|---|---|
| 4,503,101 | A * | 3/1985 | Bennett | 428/9 |
| 4,905,014 | A | 2/1990 | Gonzales | |
| 5,351,062 | A * | 9/1994 | Knapp et al. | 343/880 |
| 5,642,122 | A * | 6/1997 | Lockie et al. | 343/881 |
| 6,195,063 | B1 * | 2/2001 | Gabriel et al. | 343/797 |
| 7,460,051 | B2 * | 12/2008 | Nasvall et al. | 342/7 |
| 7,490,538 | B2 * | 2/2009 | Lowell et al. | 89/1.11 |
| 7,579,999 | B2 * | 8/2009 | Boβet al. | 343/799 |
| 7,602,348 | B2 * | 10/2009 | Goldberg | 343/881 |
| 7,730,819 | B2 * | 6/2010 | Lowell et al. | 89/1.11 |
| 7,784,390 | B1 * | 8/2010 | Lowell et al. | 89/1.11 |
| 7,847,721 | B1 * | 12/2010 | Carlsson et al. | 342/6 |
| 2007/0080883 | A1 * | 4/2007 | Boss et al. | 343/797 |
| 2008/0111757 | A1 * | 5/2008 | Bisiules et al. | 343/799 |
| 2008/0246681 | A1 * | 10/2008 | Deng et al. | 343/835 |
| 2009/0046017 | A1 * | 2/2009 | Foo | 343/700 MS |
| 2009/0073073 | A1 * | 3/2009 | Brown et al. | 343/818 |
| 2009/0146907 | A1 * | 6/2009 | Brown | 343/912 |

FOREIGN PATENT DOCUMENTS

| | | | |
|---|---|---|---|
| GB | 2463711 A * | 3/2010 | |
| KR | 870725 B1 * | 11/2008 | |

OTHER PUBLICATIONS

Kelly, K.C.; Huang, J.; , "A dual polarization, active, microstrip antenna for an orbital imaging radar system operating at L-band," Antennas and Propagation Society International Symposium, 1999, IEEE , vol. 1, no., pp. 162-165 vol. 1, Aug. 1999.*

(Continued)

*Primary Examiner* — John B Sotomayor

(74) *Attorney, Agent, or Firm* — SoCal IP Law Group LLP; Steven C. Sereboff; John E. Gunther

(57) ABSTRACT

A foldable reflect array may include a plurality of geometrically-flat reflect antennas. Each of the reflect antennas may include a respective plurality of antenna elements to receive and retransmit an incident wavefront, and each of the plurality of reflect antennas may be foldably coupled to at least one other of the plurality of reflect antennas.

20 Claims, 9 Drawing Sheets

OTHER PUBLICATIONS

Malibu Research,"Introduction to FLAPS." Flat Parabolic Surface (FLAPS) Antenna Technology, available at: http:maliburesearch.com/technology.htm, © 2006. Printed May 7, 2007, 8pp.

Soss, Joseph, "The SOSS Invisible Hinge," available at http://www.soss.com/productdesc/ . . . Undated, Printed Dec. 4, 2007, 1 pg.

* cited by examiner

FOLDABLE REFLECT ARRAY

RELATED APPLICATION INFORMATION

This patent is a continuation in part of copending application Ser. No. 11/207,049, "Weapon having lethal and non-lethal directed energy portions", filed Aug. 18, 2005, which is incorporated herein.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to antennas for portable microwave and millimeter wave systems.

2. Description of the Related Art

Microwave and millimeter wave communications, sensor, and directed energy systems commonly use reflective beam forming elements to shape and direct an output beam. The angular size, or divergence, of the output beam may be determined, at least in part, by diffraction from the aperture defined by the final beam forming element, commonly called the "main reflector" or the "primary reflector". The primary reflector is typically a geometrically curved reflector, such as a parabolic reflector, to convert a diverging wavefront from a source of microwave radiation into a collimated or nearly collimated output wavefront.

To form a narrow output beam, the primary reflector typically has a large surface area. However, a large-area primary reflector may be inconvenient or impractical in a portable system. The primary reflectors used in current portable microwave and millimeter wave system generally represent a compromise between the output beam size and portability.

Portable communications, sensor, and directed energy systems could benefit from having a foldable primary reflector able to provide both a large aperture when the system is in use and a compact form factor when the system is transported.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

Description of Apparatus

Within this description, the term "microwave" is intended to encompass both microwave and millimeter wave radiation.

Figure 1:
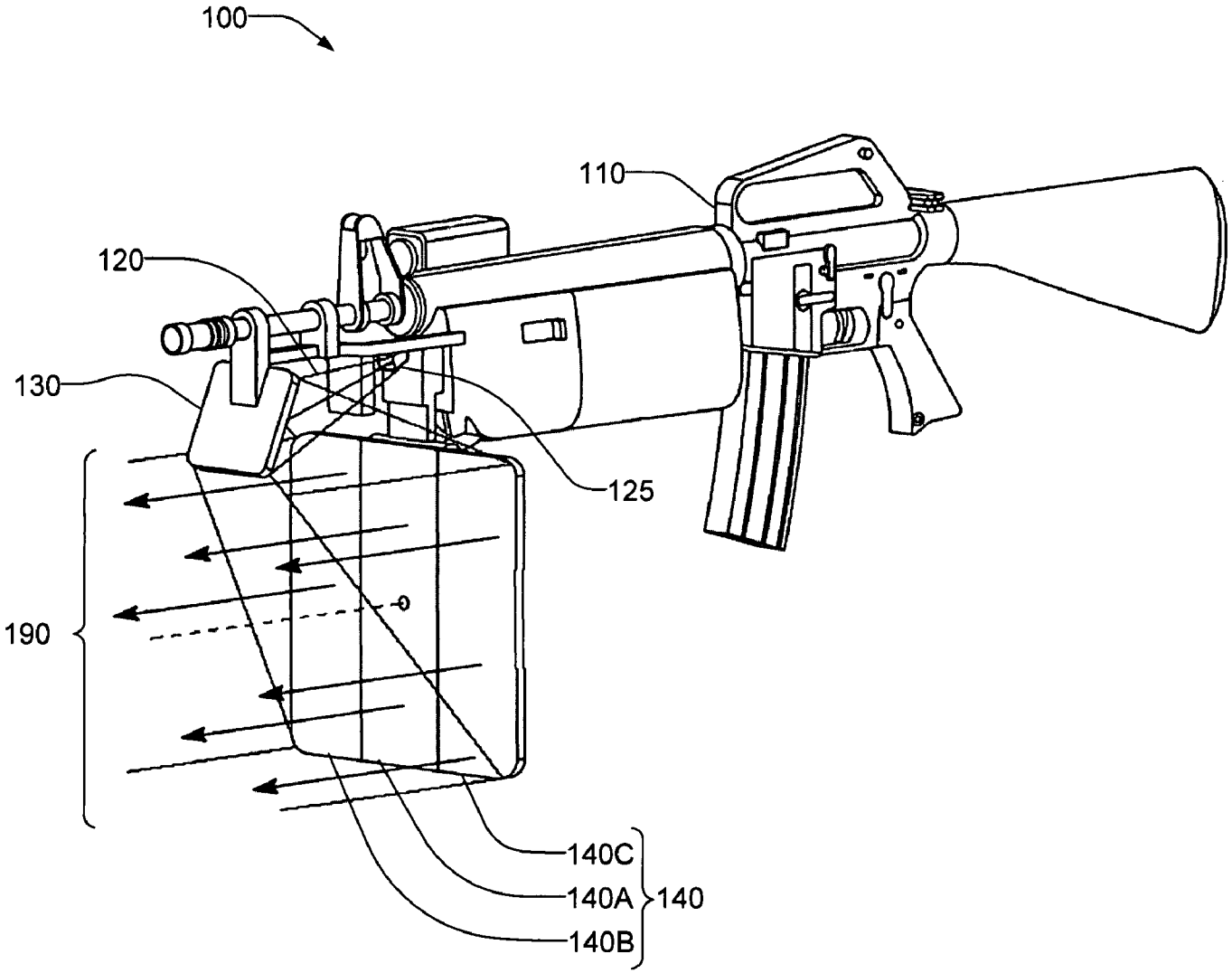
FIG. 1 is a perspective view of a weapon with a non-lethal directed energy portion with a foldable reflect array.

FIG. 1 is a perspective view of a weapon 100 as described in copending U.S. patent application Ser. No. 11/207,049. The weapon 100 may include a non-lethal portion and a lethal portion. The lethal portion may be any lethal weapon including a rifle or machine gun. The non-lethal portion may comprise a directed energy weapon including a source 125 of high power millimeter wave radiation to transmit a high-power millimeter wave initial wavefront 120, a main or primary reflector 140, and a sub-reflector 130 to reflect initial wavefront 120 to primary reflector 140. The primary reflector 140 may direct an output beam 190 toward a target (not shown). The primary reflector 140 may be a collimating reflector to generate a collimated wavefront directed toward the target. The primary reflector 140 may form a converging wavefront which may converge at or near the intended target.

The angular size of the output beam 190 may be determined, at least in part, by diffraction from the aperture defined by the primary reflector 140. To form a narrow output beam 140, the primary reflector may have a large surface area. However, a large area primary reflector may reduce the portability of the weapon 100. To provide a compromise between the output beam size and portability, the primary reflector 140 may be foldable to provide a more compact form factor when the non-lethal portion of the weapon 100 is not in use. For example, the primary reflector 140 may be formed of three foldably coupled sections, or sub-arrays, 140A, 140B, 140C. In this description, the term "foldably coupled" means joined by hinges, pivots, or other mechanisms that allow the sections to be folded. The three sub-arrays 140A, 140B, 140C may be essentially coplanar, as shown in FIG. 1, when the weapon 100 is ready for use.

Figure 2:
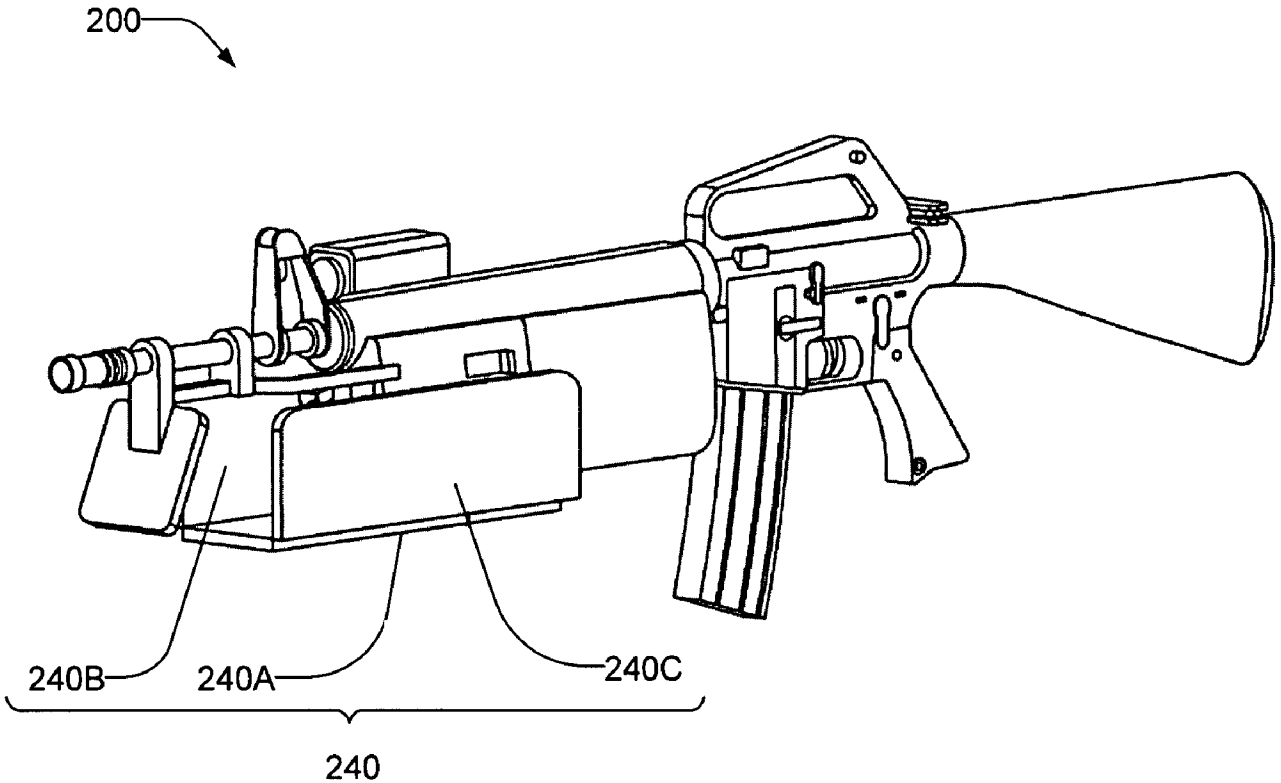
FIG. 2 a perspective view of a weapon with a foldable reflect array in a folded condition.

FIG. 2 is a perspective view illustrating a weapon 200, which may be the weapon 100, including a 3-section primary reflector 240 shown in a fully folded-up position. A center sub-array 240A of the primary reflector may be coupled by a hinge (not shown) or other mechanism to weapon 200. Left and right sub-arrays 240B, 240C of the primary reflector may be foldably coupled to the center sub-array 240A, such that the left and right sub-arrays 240B, 240C fold up at least partially around the weapon 200.

It must be understood that the directed energy non-lethal portion of the weapon 100 and the weapon 200 is an exemplary application of a foldable primary reflector. Any system having a transmitter and/or receiver of microwave radiation may benefit from a foldable primary reflector. Such systems may include microwave communication systems, sensor systems, and other applications where a large reflector area is desired during operation and a reduced form factor is desired for portability.

Referring back to FIG. 1, the primary reflector 140 may comprise a geometrically-flat electrically-parabolic surface reflector antenna having a plurality of antenna elements to receive and retransmit an incident wavefront. The antenna elements may have their electrical shapes optimized to generate either a collimating or converging wavefront. The antenna elements may, for example include a plurality of dual-polarized dipoles that circumferentially vary in size. The individual antenna elements may have varying sizes and shapes to receive the wavefront reflected by sub-reflector 130 and generate the output wavefront 190 as either a collimated wavefront or a converting wavefront. An example of a reflector suitable for use as primary reflector 140 may include the geometrically-flat electrically-parabolic surface reflector antenna disclosed in U.S. Pat. No. 4,905,014.

Other examples of reflect arrays that may be suitable for use as the foldable primary reflector 140 includes the reflect array described in copending application Ser. No. 11/861,621, entitled "Low Loss, Variable Phase Reflecting Surface", filed Sep. 26, 2007, and the reflect array described in copending application Ser. No. 11/952,799, entitled "Multiple Frequency Reflect Array", filed Dec. 7, 2007.

Figure 3:
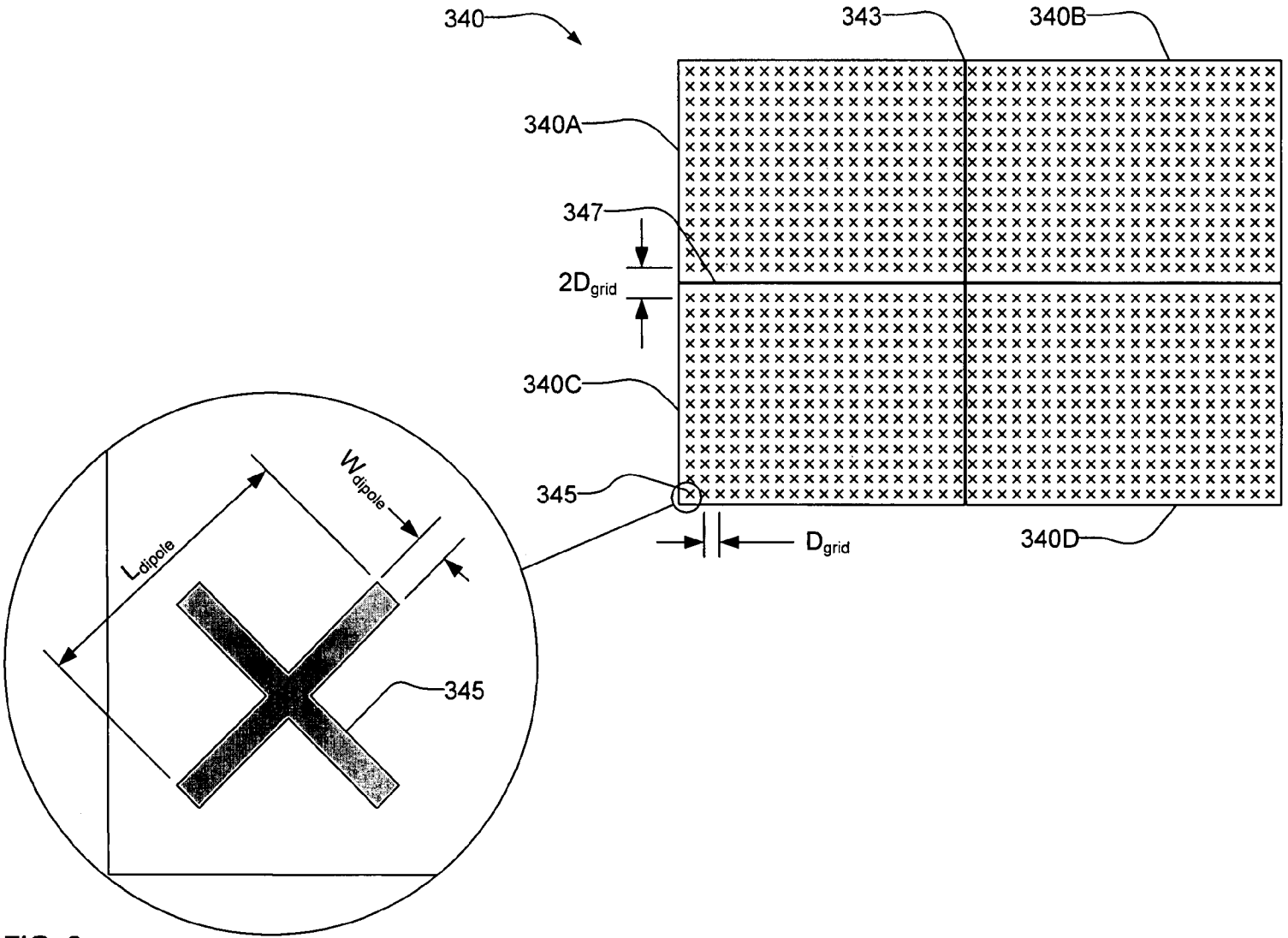
FIG. 3 is a plan view of a reflect array.

Referring now to FIG. 3, a reflect array 340 may include a two-dimensional array or grid of conductive antenna elements, such as antenna element 345. The dimensions and shape of each antenna element may determine the electrical phase shift induced when microwave radiation is reflected from the reflect array. Thus the antenna elements may commonly be referred to as "phasing elements". As shown in FIG. 3, the antenna elements may be disposed on a rectangular grid and the distance between adjacent rows and columns of antenna elements may be $D_{grid}$. In this description, the terms "rows" and "columns" refer to the elements of the reflect array as shown in the figures and do not imply any absolute orientation of the reflect array. However, it is not required that the antenna elements be arrange don a rectangular grid, or that the rows and columns of a grid be evenly spaced.

The reflect array 340 may be adapted to reflect microwave radiation within a predetermined wavelength band. The distance $D_{grid}$ may be less than one wavelength, and may be about 0.5 wavelengths, of the microwave radiation in the predetermined frequency band.

Each antenna element such as element 345 may have an "X" shape, but the antenna elements may have other shapes. X-shaped antenna elements may operate as dual-polarized dipole structures, and may be characterized by dimensions $L_{dipole}$ and $W_{dipole}$. At least one dimension of the antenna elements may be varied across the reflect array. In the exemplary reflect array 340, the dimension $L_{dipole}$ may be varied between the rows and columns of the reflect array. A variation in the size of the antenna elements may be used to control the phase shift of microwave energy reflected from the reflect array and thus shape the wavefront of the reflected microwave energy.

The width of the antenna elements ($W_{dipole}$) may not be critical to the performance of the reflect array. The width of the antenna elements may be from 0.01 to 0.1 times the wavelength of operation of the reflect array, or some other dimension.

The reflect array 340 may be comprised of four section, or sub-arrays, 340A, 340B, 340C, 340D joined at least in part by hinges or other mechanisms that allow the sub-arrays to be folded. The boundary of adjacent sub-arrays may pass between elements of the two-dimensional array of conductive elements, as shown by a fold line 343 between sub-arrays 340A and 340B. In this case, the distance between adjacent rows and columns of antenna elements, $D_{grid}$, may be maintained across adjacent sub-arrays such as sub-arrays 340A and 340B. The boundary of adjacent sub-arrays may essentially replace a row or column of elements in the two-dimensional array of conductive elements, as shown by a fold line 347 between sub-arrays 340A and 340C. In this case, the distance between adjacent rows and columns of antenna elements, $D_{grid}$, may be maintained within adjacent sub-arrays except for a space of 2 $D_{grid}$ between the elements on either side of the interface.

Figure 4:
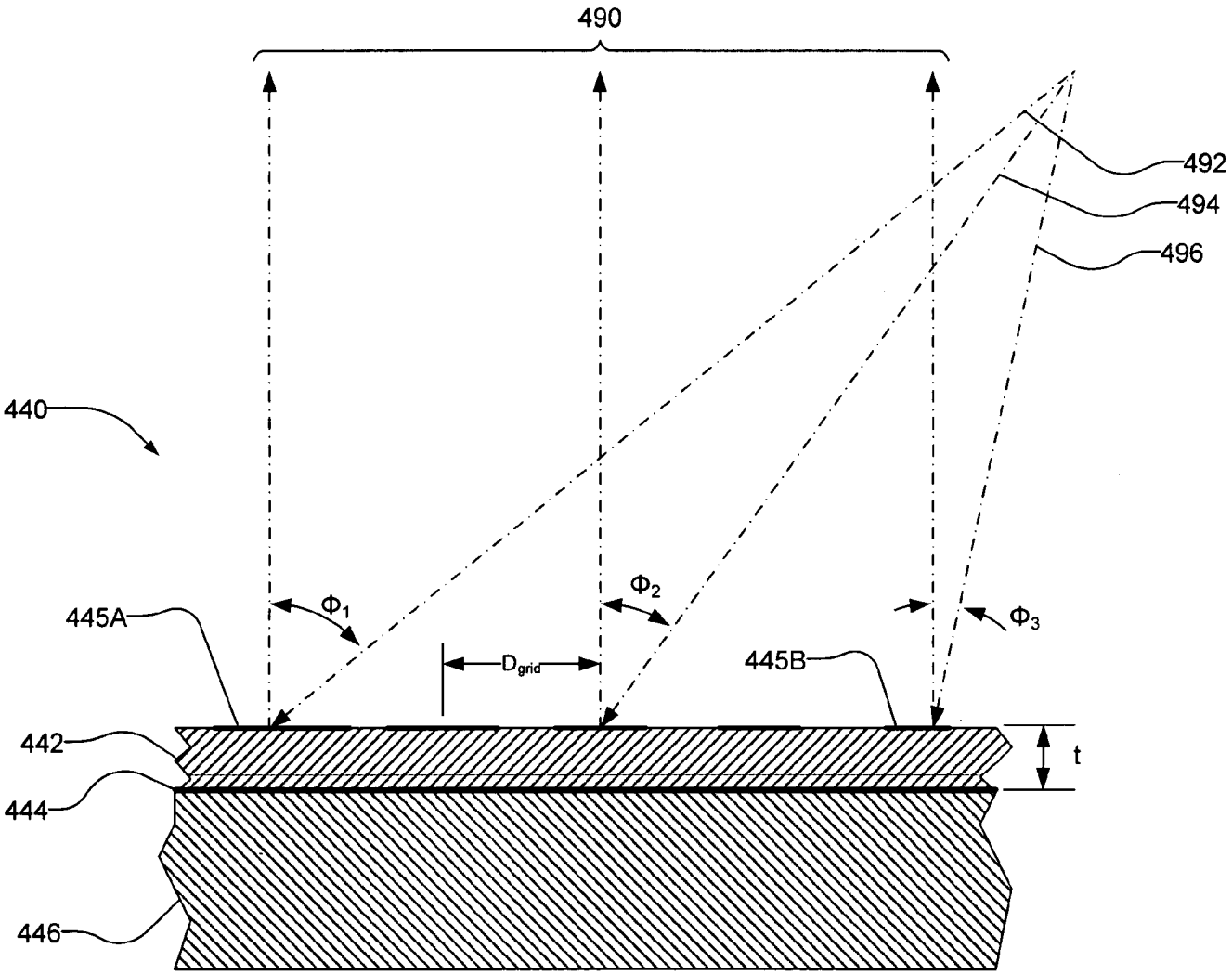
FIG. 4 is a side view of a reflect array.

Referring now to FIG. 4, a reflect array 440, which may be the reflect array 140 or another reflect array, may include a dielectric substrate 442. The dielectric substrate 442 may be a ceramic material, a composite material such as DUROID® (available from Rogers Corporation), or some other dielectric material suitable for use at the frequency of interest. The dielectric substrate 442 may have a thickness t. The thickness t may be substantially less than one wavelength of the microwave radiation in the predetermined frequency band to prevent higher-order diffraction modes from being reflected by the reflect array. The thickness may be about 0.1 times the wavelength of operation of the reflect array.

The dielectric substrate 442 may be supported by a structure 446. Although the structure 446 is shown in FIG. 4 as a solid object, the structure 446 may be a solid material, a foam material, a honeycomb, a waffle structure, or other structure that provides support and rigidity to the dielectric substrate 442. The structure 446 may be metal, ceramic, plastic, other material, or a combination thereof.

A continuous conductive ground plane layer 444 may be disposed between the dielectric substrate 442 and the structure 446. The ground plane layer 444 may be a thin metallic film deposited onto the surface of the dielectric substrate 442, or may be a metallic foil laminated to the dielectric substrate 442. The ground plane layer 444 may be a metal element, such as a metal plate that may also function as a heat sink, bonded or otherwise affixed to the dielectric substrate 442. The ground plane player 444 may be a portion of the structure 446.

In a reflect array having foldable sub-arrays, such as the reflect array 340 having sub-arrays 340A, 340B, 340C, 340D, it may not be necessary to provide electrical connection between the ground planes of the adjacent sub-arrays. A gap between the ground planes of adjacent sub-arrays may not impact the performance of the reflect array if the width of the gap is smaller than a fraction of a wavelength at the frequency of use.

The surface of the dielectric substrate 442 may support an array of conductive antenna elements such as elements 445A and 445B. The antenna elements may be formed by patterning a thin metallic film deposited onto the dielectric substrate 442, or by patterning a thin metallic foil laminated onto the dielectric substrate 442, or by some other method.

At least one dimension of the antenna elements may be varied across the reflect array 440. In the example of FIG. 4, the length of the antenna elements is varied such that antenna element 445A is longer than antenna element 445B. The variation in the dimension of the antenna elements may result in a variation of the phase shift of microwave radiation reflected from the reflect array 440. For example, incident microwave radiation 492 may be reflected with a phase shift of $\phi_1$, incident microwave radiation 494 may be reflected with a phase shift of $\phi_2$, and incident microwave radiation 496 may be reflected with a phase shift of $\phi_3$. The variation in phase shift across the reflect array 440 may redirect and/or change the wavefront of the reflected microwave radiation. In the example of FIG. 4, incident microwave radiation 492, 494, 496 may be portions of a spherical wave emanating from a point source. The reflected wavefront 490 may be a plane, or collimated wavefront. Thus, in the example of FIG. 4, the planar reflect array 440 may emulate the optical characteristics of an off-axis parabolic reflector.

The reflect array 440 may be a bidirectional device also capable of focusing a collimated input beam to a point.

By properly varying the phase shift across the extent of a reflect array, a reflect array having a first curvature may be adapted to emulate the optical characteristics of a reflector having a second curvature different from the first curvature. In particular, a geometrically flat reflect array may be adapted to emulate a parabolic reflector, a spherical reflector, a cylindrical reflector, a torroidal reflector, a conic reflector, a generalized aspheric reflector, or some other curved reflector. A reflect array that emulates a curved or parabolic surface may be referred to as "electrically curved" or "electrically parabolic".

Figure 5:
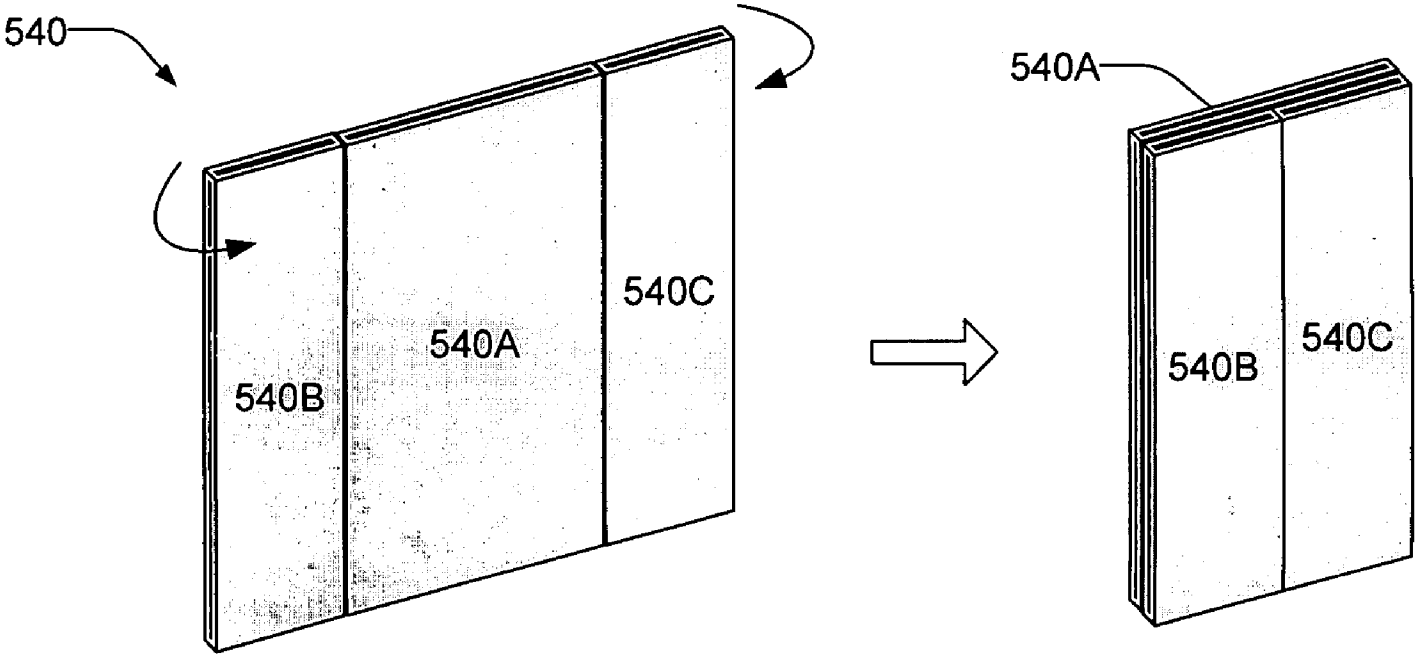
FIG. 5 is a perspective schematic view of a foldable reflect array.
Figure 6:
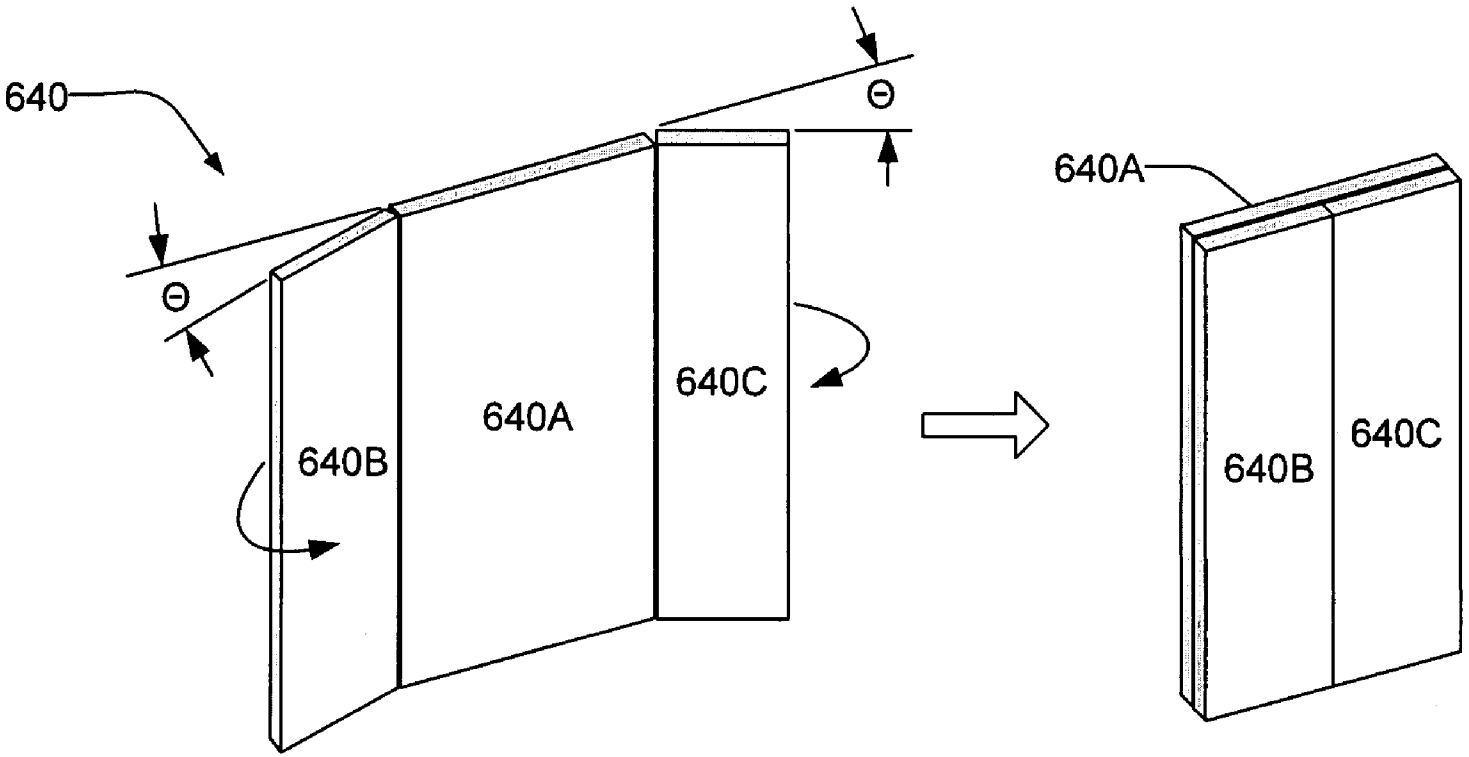
FIG. 6 is a perspective schematic view of a foldable reflect array.

FIG. 5 and FIG. 6 show schematic perspective views of exemplary foldable reflect arrays in the unfolded and folded states. Hinges and/or other mechanisms coupling the sub-arrays of the foldable reflect arrays are not shown.

FIG. 5 shows an exemplary foldable reflect array 540 composed of a center sub-array 540A and two side sub-arrays 540B, 540C. The three sub-arrays 540A, 540B, 540C may be essentially coplanar when the foldable reflect array 540 is in use. The side sub-arrays 540B, 540C may fold over the center sub-array 540A when the foldable reflect array is not in use.

FIG. 6 shows a foldable reflect array 640 which is similar to the foldable reflect array 540. The foldable reflect array 640 may include a center sub-array 640A and two side sub-arrays 640B, 640C. The center sub-array 640A and two side sub-arrays 640B, 640C may not be coplanar when the foldable reflect array 640 is in use. When the foldable reflect array 640 is in the "unfolded" state, each side sub-array 640B, 640C may be inclined at a predetermined angle Θ with respect to the plane of the center sub-array 640A. The antenna elements on the side sub-arrays 640B, 640C may be adapted to provide high efficiency and appropriate phase shifts at the predetermined angle Θ. The side sub-arrays 640B, 640C may fold over the center sub-array 640A when the foldable reflect array is not in use.

Figure 7:
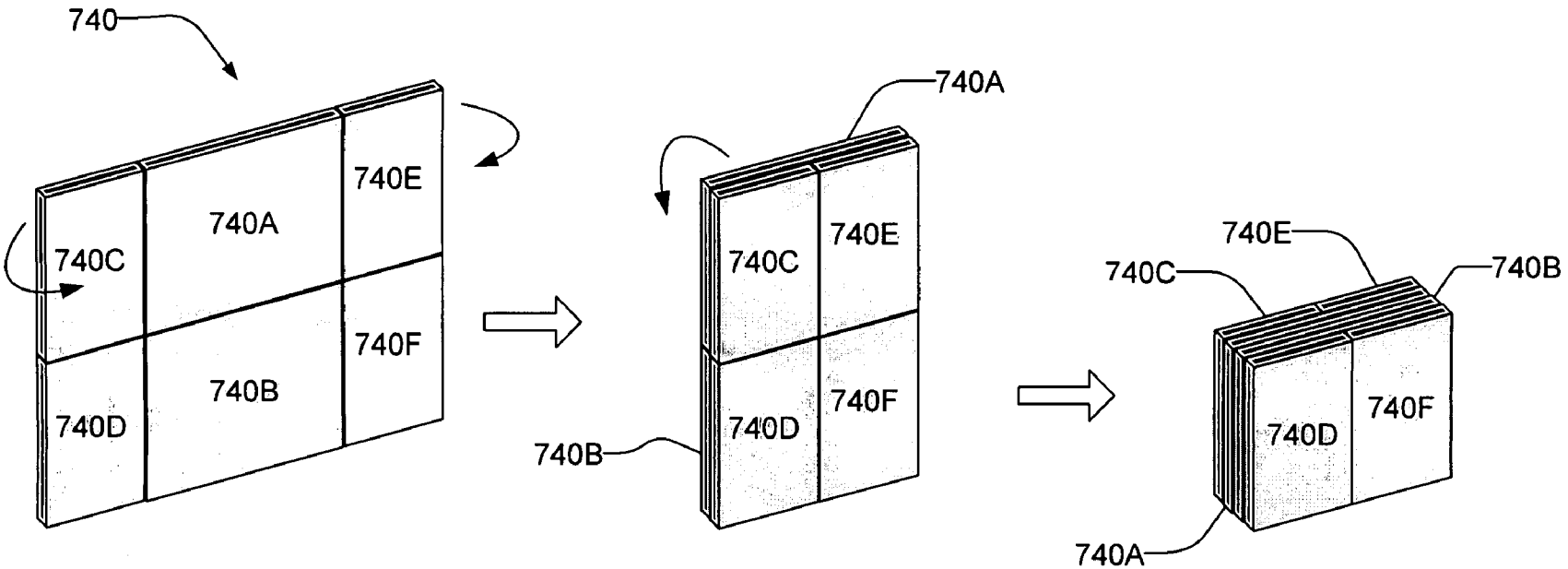
FIG. 7 is a perspective schematic view of a foldable reflect array.

FIG. 7 illustrates another exemplary foldable reflect array 740 which may include six sub-arrays 740A-740F. The six sub-arrays 740A-740F may be foldable along three fold lines such that the fully folded reflect array has a cross-sectional area that is one-fourth of the cross-sectional area of the foldable reflect array in the unfolded state.

Figure 8:
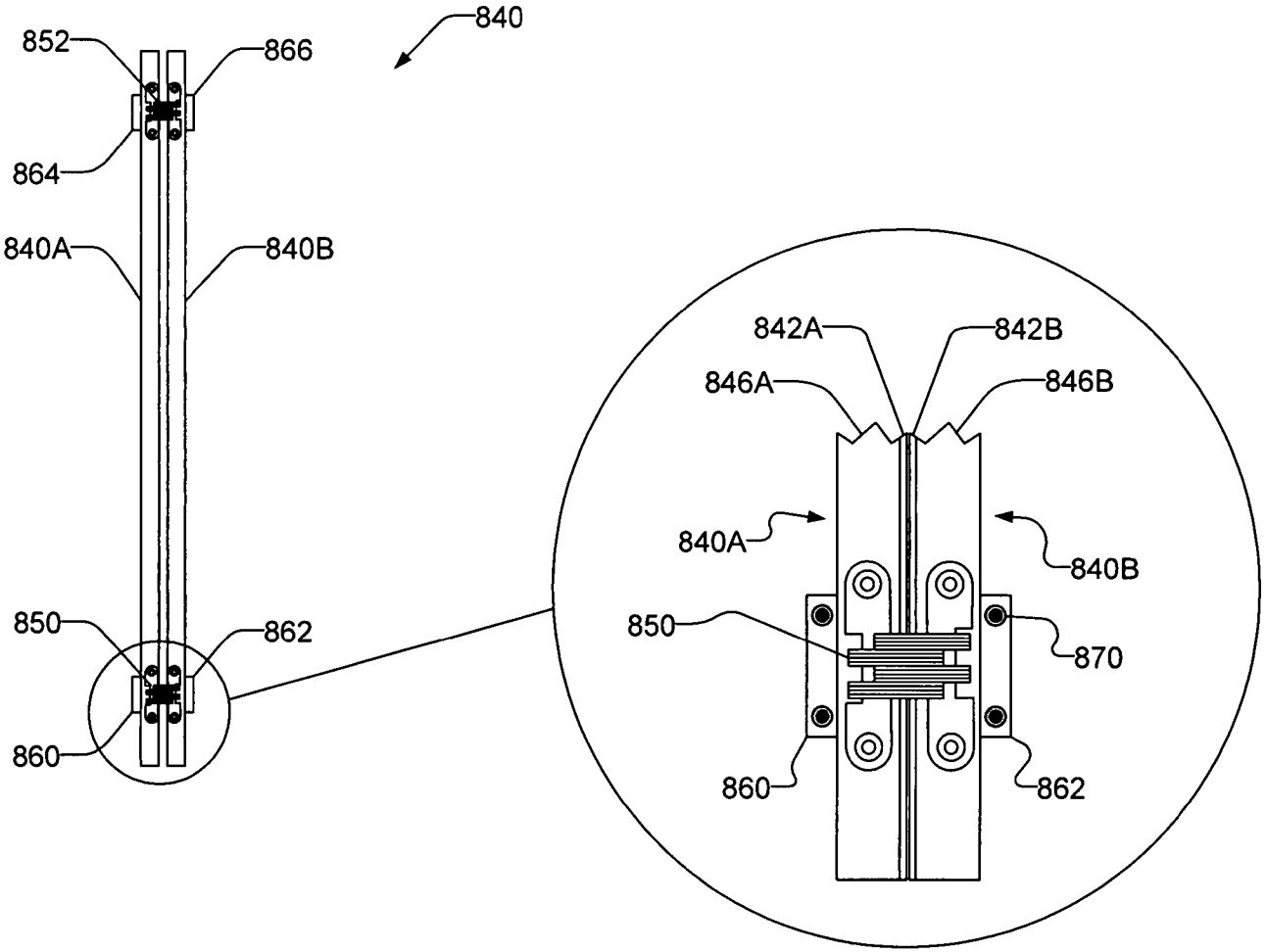
FIG. 8 is a side view of a foldable reflect array in the folded condition.

FIG. 8 shows a side view of an exemplary reflect array 840 in a folded condition. Two sub-arrays 840A, 840B may include respective dielectric substrates 842A, 842B and supporting structures 846A, 846B. The two sub-arrays 840A. 840B may be foldably coupled by hinges 850, 852. The hinges may attach to the structures 846A, 846B. The use of two hinges is exemplary, and other numbers of hinges may be used to foldably couple two sub-arrays. In this example, the hinges 850, 852 are so-called "Soss invisible hinges" manufactured by Universal Industrial Products. Other types of hinges, such as piano hinges, and other mechanisms may be used to foldably couple two sub-arrays.

A first plurality of catches 860, 862, 864, 866 may be attached to or disposed within the structure 846A, 846B of the two sub-arrays 840A, 840B. Within this description, the term "catch" is used with the normal definition of "a device for temporarily holding immovable an otherwise movable part". The catches 860, 862, 864, 866 may be effective to hold the two sub-arrays immovable in an unfolded condition. Each of the catches 860, 862, 864, 866 may include one or more magnets, such as magnet 870. When the sub-arrays are in the unfolded condition, each catch may be attracted to and temporarily attach to a corresponding magnet or ferromagnetic material in a mating catch. The catches 860, 862, 864, 866 may be mechanical devices, such as manually-operated or spring-loaded latches, rather than magnetic.

Figure 9B:
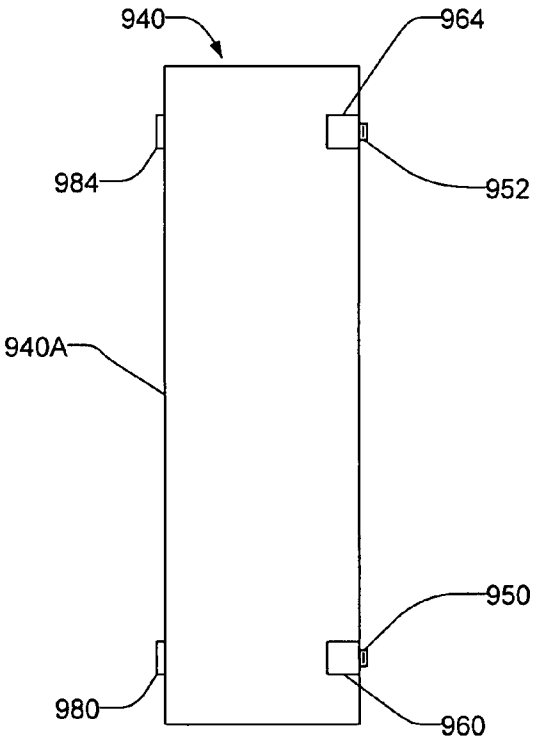
FIG. 9B is a back view of a foldable reflect array in the folded condition.
Figure 9C:
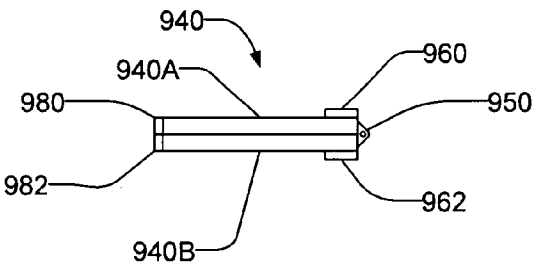
FIG. 9C is an end view of an exemplary foldable reflect array in the folded condition.
Figure 9A:
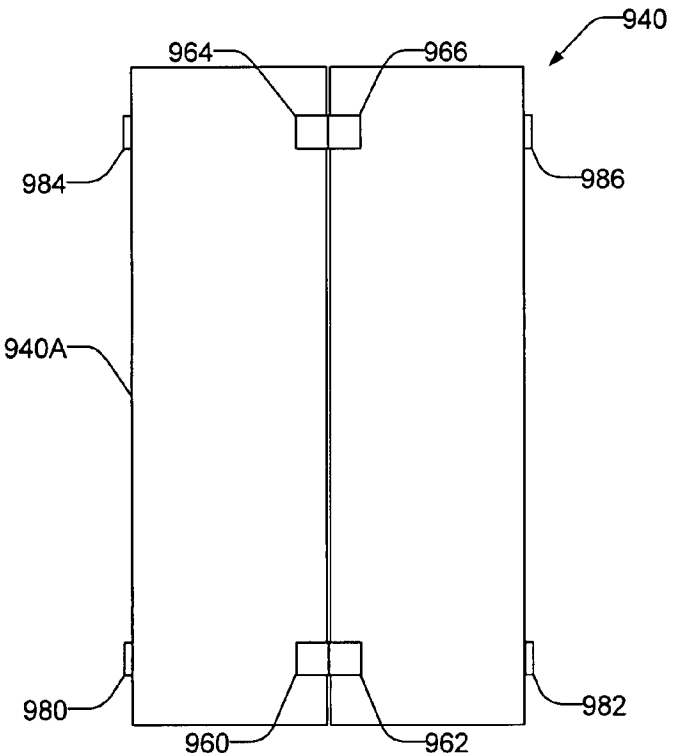
FIG. 9A is a back view of a foldable reflect array in an unfolded condition.

FIG. 9A shows a back view of a foldable reflect array 940, which may be the reflect array 840, in an unfolded condition. FIG. 9B and FIG. 9C show back and end views, respectively of the foldable reflect array 940 in a folded condition.

The foldable reflect array 940 may include two or more sub-arrays 940A, 940B. The sub-arrays 940A, 940B may be foldably coupled by two or more hinges 950, 952. A first plurality of catches 960, 962, 964, 966 may be attached to or disposed within the sub-arrays 940A, 940B. As shown in FIG. 9A, the first plurality of catches may be engaged in pairs 960/962, 964/966 to hold the sub-arrays 940A, 940B immovable in the unfolded condition. The first plurality of catches 960, 962, 964, 966 may be magnetic or mechanical latches.

The combination of hinges 950, 952 and catches 960, 962, 964, 966 may be effective to register the unfolded sub-arrays to within a small fraction of a wavelength at the frequency of use. For example, the combination of hinges and catches may be effective to align the sub-arrays within a tolerance of one-tenth of a wavelength. In applications where more precise alignment is required, a precision alignment mechanism, such as pins that precisely mate with corresponding slots or sockets, may be added to the foldable reflect array.

A second plurality of catches 980, 982, 984, 986 may be attached to or disposed within the structure of the two sub-arrays 940A, 940B. The catches 980, 982, 984, 986 may be effective to hold the two sub-arrays 940A, 940B immovable in a folded condition. Each of the catches 980, 982, 984, 986 may include one or more magnets. When the sub-arrays are in the folded condition, each catch may be attracted to and temporarily attach to a corresponding magnet or ferromagnetic material in a mating catch. For example, catch 980 and catch 982 are shown mated in FIG. 9C. The catches 980, 982, 984, 986 may be mechanical, rather than magnetic, devices, such as manually-operated or spring-loaded latches.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

It is claimed:

1. A foldable reflect array, comprising:

a plurality of geometrically-flat sub-arrays, each of the plurality of sub-arrays comprising:

a dielectric substrate, a plurality of antenna elements formed on a first surface of the dielectric substrate to reflect an incident wavefront, and a ground plane layer disposed on a second surface of the dielectric substrate, wherein each of the plurality of sub-arrays is foldably coupled to at least one other of the plurality of sub-arrays.

2. The foldable reflect array of claim 1, wherein at least one dimension of the plurality of antenna elements is varied across an extent of each sub-array.

3. The foldable reflect array of claim 2, wherein the at least one dimension of the plurality of antenna elements is varied such that each of the plurality of sub-arrays emulates the optical characteristics of a curved surface.

4. The foldable reflect array of claim 2, wherein the at least one dimension of the plurality of antenna elements is varied such that each of the plurality of sub-arrays emulates the optical characteristics of a parabolic surface.

5. The foldable reflect array of claim 1, wherein each of the pluralities of antenna elements is an X-shaped dual-polarized dipole antenna element.

6. The foldable reflect array of claim 1, wherein in an unfolded state, the plurality of sub-arrays are essentially coplanar.

7. The foldable reflect array of claim 1, wherein in an unfolded state, at least one of the plurality of sub-arrays is inclined at a predetermined angle with respect to an adjacent sub-array.

8. The foldable reflect array of claim 1, wherein the foldably-coupled sub-arrays are coupled by hinges.

9. The foldable reflect array of claim 1, further comprising a first plurality of catches effective to hold the sub-arrays immovable in an unfolded condition.

10. The foldable reflect array of claim 1, further comprising a second plurality of catches effective to hold the sub-arrays immovable in a folded condition.

11. A portable apparatus, comprising:

at least one of a transmitter to transmit microwave radiation and a receiver to receive microwave radiation a reflect array primary reflector to couple a beam of microwave radiation to the at least one of a transmitter and a receiver, the primary reflector comprising a plurality of geometrically-flat sub-arrays, each sub-array further comprising:

a dielectric substrate, a plurality of antenna elements formed on a first surface of the dielectric substrate to reflect an incident wavefront, and a ground plane layer disposed on a second surface of the dielectric substrate, wherein each of the plurality of sub-arrays is foldably coupled to at least one other of the plurality of sub-arrays.

12. The foldable reflect array of claim 11, wherein at least one dimension of the plurality of antenna elements is varied across an extent of each sub-array.

13. The foldable reflect array of claim 12, wherein the at least one dimension of the plurality of antenna elements is varied such that each of the plurality of sub-arrays emulates the optical characteristics of a curved surface.

14. The foldable reflect array of claim 12, wherein the at least one dimension of the plurality of antenna elements is varied such that each of the plurality of sub-arrays emulates the optical characteristics of a parabolic surface.

15. The portable apparatus of claim 11, wherein each of the pluralities of antenna elements is an X-shaped dual-polarized dipole antenna element.

16. The portable apparatus of claim 11, wherein in an unfolded state, the plurality of sub-arrays are essentially coplanar.

17. The portable apparatus of claim 11, wherein in an unfolded state, at least one of the plurality of sub-arrays is inclined at a predetermined angle with respect to an adjacent sub-array.

18. The portable apparatus of claim 11, wherein the foldably-coupled sub-arrays are coupled by hinges.

19. The portable apparatus of claim 11, the primary reflector further comprising a first plurality of catches effective to hold the sub-arrays immovable in an unfolded condition when the apparatus is ready for use.

20. The portable apparatus of claim 11, the primary reflector further comprising a second plurality of catches effective to hold the sub-arrays immovable in a folded condition when the apparatus is ready for transport.

* * * * *